United States Patent [19]

Edwards

[11] 4,202,487

[45] May 13, 1980

[54] LIPOPROTEIN ROTOR LID

[75] Inventor: John R. Edwards, Mountainview, Calif.

[73] Assignee: Beckman Instruments, Inc., Fullerton, Calif.

[21] Appl. No.: 879,939

[22] Filed: Feb. 22, 1978

[51] Int. Cl.[2] ..... B04B 7/02; B04B 7/08

[52] U.S. Cl. ..... 233/1 A; 233/26; 233/27

[58] Field of Search ..... 233/1 R, 1 A, 26, 27, 233/28, DIG. 1

[56] References Cited

U.S. PATENT DOCUMENTS

| | | | |
|---|---|---|---|
| 2,876,949 | 3/1959 | Skarstrom | 233/DIG. 1 |
| 3,028,075 | 4/1962 | Blum | 233/26 |
| 3,344,984 | 10/1967 | Kopczynski | 233/27 X |
| 3,366,320 | 1/1968 | Cho | 233/26 |
| 3,567,113 | 3/1971 | Stansell et al. | 233/26 X |
| 3,819,111 | 6/1974 | Romanauskas et al. | 233/27 |
| 3,843,045 | 10/1974 | Schmidt | 233/27 |
| 3,901,434 | 8/1975 | Wright | 233/27 |
| 3,955,755 | 5/1976 | Breillatt et al. | 233/27 X |

*Primary Examiner*—George H. Krizmanich
*Attorney, Agent, or Firm*—R. J. Steinmeyer; F. L. Mehlhoff; William H. May

[57] ABSTRACT

A rotor apparatus utilizing a lid having an enlarged rim portion which under centrifugally induced forces will move into close sealing contact with the lower portion of the rotor. The lid portion of the rotor is a generally flat circular disc with the thicker rim portion of greater mass located around the periphery of the circular disc. The slight deflection of the lid during centrifugation provides an automatic increase in the seal between the lid and the lower portion of the rotor as the rotational speed increases. The automatic tightening feature enables the user to merely hand tighten the lid onto the lower portion of the rotor without having to use some type of mechanical advantage tool. The lid has a relatively large diameter and contains no holes in order to reduce possible material stress in the lid during centrifugation. The lid is threadably connected to the lower portion of the rotor by a depending stud projecting from the bottom surface of the lid.

4 Claims, 4 Drawing Figures

LIPOPROTEIN ROTOR LID

BACKGROUND OF THE INVENTION

The present invention is directed to a rotor and, more particularly, is directed to a relatively large diameter rotor lid which in conjunction with the lower rotor portion automatically increases the sealing effect between the rotor lid and the lower portion of the rotor during centrifugation.

Certain types of rotors are designed for the centrifugation of very small samples which must be situated a relatively large distance with respect to the test tube size from the axis of rotation in order to achieve acceptable separation results during centrifugation. However, in order to properly isolate the fluid samples in the rotor from the vacuum environment which exists within the centrifuge, a lid must be sealed over the test tube cavities. Since the fluid samples are located a considerable distance from the spin axis of the rotor, it is necessary to utilize a relatively large diameter lid on the rotor.

Typically, rotor lids are generally smaller in diameter with respect to the outer diameter of the rotor. In addition, these rotor lids normally have a central aperture to receive a projecting shaft from the lower portion of the rotor. A handle or cap-like nut is screwed onto this projecting threaded shaft which can be tightened down sufficiently with a proper tightening tool to provide a seal between the outer perimeter of the lid and the outer perimeter of the lower portion of the rotor.

However, the larger the rotor lid having a center hole is, the greater the stress experienced on the lid during centrifugation. For example, the maximum material stress on a lid with a hole will be approximately twice that which would be experienced by the same sized lid having no hole. As the lid becomes larger in diameter, the effects of the hole with respect to the centrifugally induced forces during centrifugation becomes extremely great resulting in an undesirable design feature. Also, as the diameter of the lid increases it is difficult to tighten the center portion of the lid enough by the use of a threaded nut or handle over the stud from the lower end of the rotor. The necessary sealing contact between the outer perimeter of the rotor lid and the perimeter of the lower portion of the rotor is not established.

Another problem typically associated with the sealing between the lid and the rotor is proper retention of the O-ring in place between the lid and the rotor to maintain the seal. Quite often the design of the rotor and lid is not adequate to keep the O-ring in place during high speed rotation. In many instances the O-ring will creep away from its sealing position as a result of high centrifugally induced forces, adversely affecting the seal between the lid and the rotor.

The problems expressed above become more magnified as the speed to which the rotor is subjected is increased.

SUMMARY OF THE INVENTION

The rotor lid apparatus of the present invention comprises a flat circular disc having a thicker outer perimeter which is designed to mate with the outer perimeter of the rotor. The rotor has an annular recess between a central raised portion and an outer raised perimeter area. The lid utilizes a depending threaded stud which is threadably engaged into a threaded aperture within the central portion of the rotor. An O-ring is located between the outer raised perimeter area of the rotor and the enlarged rim of the lid.

The lid is capable of being manually tightened down onto the rotor to provide relatively close engagement between the lid and the rotor. During centrifugation the enlarged rim of the lid will deflect into closer engagement with the outer rim portion of the rotor to automatically provide an even tighter seal between the lid and the rotor. The deflection of the lid is allowed because of the presence of the annular recessed area in the rotor.

Since the rotor lid has a depending threaded stud, there are no apertures in the lid to facilitate connection with the rotor. Therefore, the lid can be made of a relatively large diameter for the rotor and will not be subjected to the greatly increased material stress during centrifugation as in the case of a large diameter lid with an aperture in its center.

Because the lid is designed to automatically increase its sealing at the perimeter of the lid and the rotor during centrifugation, there is no requirement for some type of mechanical advantage tool to be utilized each time that the lid is to be placed over the rotor prior to a centrifugation run. The ability of the lid and the rotor to automatically increase their seal sufficiently as centrifugation increases eliminates the concern of trying to tighten the lid with a tool to insure a proper seal during centrifugation. In the case of relatively large diameter rotor lids, the ability to directly tighten the lid sufficiently to create the necessary seal around its perimeter is difficult. Therefore, the utilization of the lid design of the present invention automatically accommodates and provides the necessary sealing between the lid and the rotor during centrifugation.

The present lid design properly retains the O-ring in place to maintain the seal during high speed rotation. The configuration of the enlarged rim on the lid results in a downward force on the O-ring and holds it in place during centrifugation.

The lid design of the present invention provides a relatively large diameter lid which not only eliminates the typical high material stress which would be found with a lid having a central aperture, but also the difficulty encountered in attempting to directly create the seal between the lid and the lower portion of the rotor prior to the centrifugation run.

DETAILED DESCRIPTION OF THE INVENTION

Figure 1:
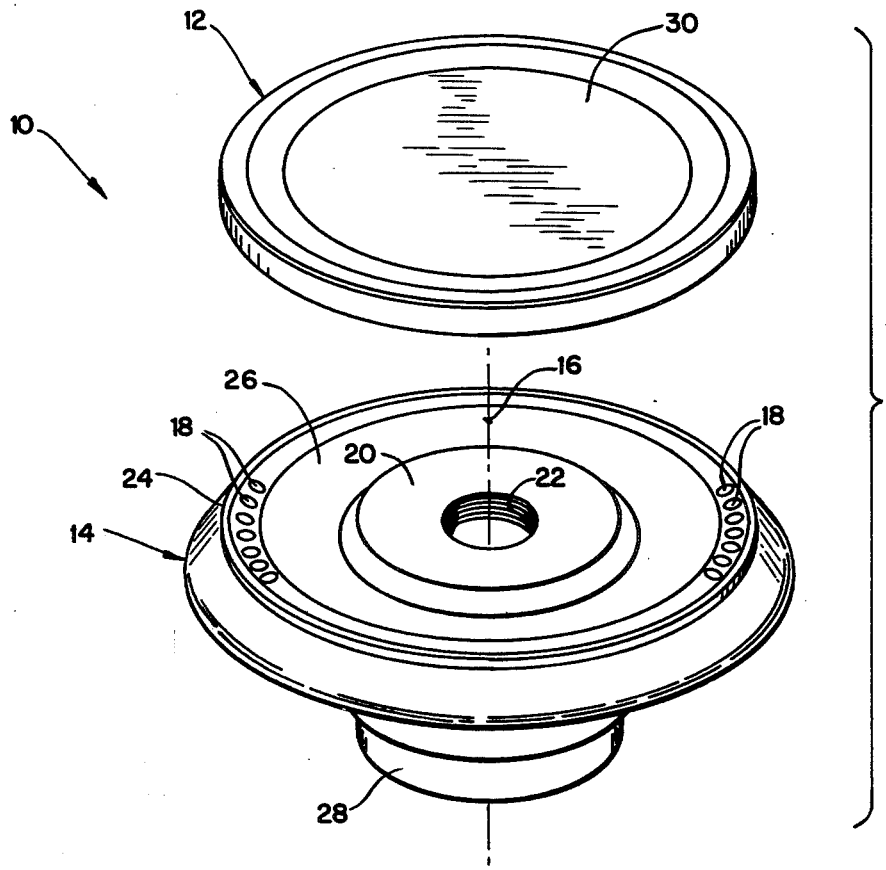
FIG. 1 is an exploded perspective view of the rotor lid apparatus.

FIG. 1 shows the rotor apparatus 10 of the present invention comprising a lid 12 and a lower rotor portion 14. The present rotor apparatus 10 is primarily designed as a Lipoprotein rotor for special application and performance requirements in chlolesterol analysis. The fluid samples for centrifugation are typically very small and to attain the necessary centrifugation forces it is necessary that the fluid samples be situated at a relatively large distance from the spin axis 16 of the rotor. Consequently, in the lower portion 14 of the rotor a plurality of small cavities 18 are situated completely around the periphery of the rotor at a slight angle with respect to the spin axis 16 as shown more clearly in FIG. 3.

In the center of the lower portion 14 of the rotor in FIG. 1 is a raised hub or central area 20 having a threaded aperture 22. Located between the raised central area 20 and the raised perimeter area 24 of the lower portion 14 of the rotor is an annular recessed area 26. This annular recessed area is designed to reduce the material stress on the threaded aperture 22 but also contributes to the desired sealing operation of the rotor lid during centrifugation as will be explained herein. The bottom section 28 of the rotor is designed to engage with a drive mechanism (not shown) to generate the rotational movement of the rotor during centrifugation.

The lid 12 has a central flat disc area 30 and a thickened rim area portion 32. Located in the center of the bottom surface 34 of the lid in FIG. 3 is a threaded stud 36 designed to engage with the threaded aperture 22 in the lower portion of the rotor.

Figure 2:
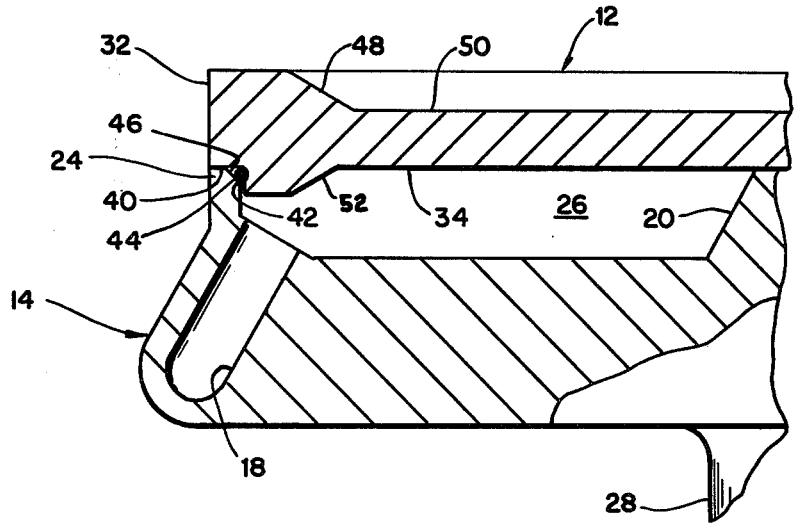
FIG. 2 is an enlarged partial sectional view of the rotor lid apparatus.

As shown more clearly in FIG. 2, when the lid 12 is threadably engaged with the lower portion 14 of the rotor, the thickened rim 32 is designed to engage with the raised perimeter area 24 of the lower portion 14 of the rotor. The rim portion 32 has a recessed shoulder area 40 with a curved corner 42 designed to receive an O-ring 44. The raised perimeter area 24 of the lower portion of the rotor is designed to mate within the recessed shoulder area 40 in the rim. The raised perimeter area 24 of the lower rotor portion has an inward sloping surface 46 which is designed to mate with the O-ring so that a tight seal is established between the rim 32 and the raised perimeter 24 of the lower portion of the rotor.

As shown in FIG. 2, a greater mass portion 48 of the rim is above the top surface 50 of the lid than the mass portion 52 on the rim below the bottom surface 34 of the lid. It should be noted that the lid is unsupported along its bottom surface 34 radially between the raised central hub 20 and the raised perimeter area 24 of the lower rotor portion.

Figure 3:
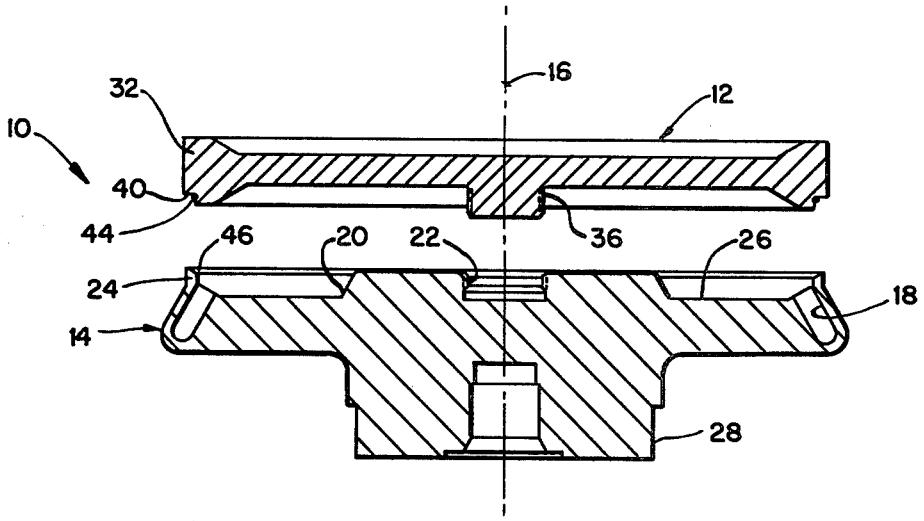
FIG. 3 is an exploded sectional elevation view of the lid and the rotor.
Figure 4:
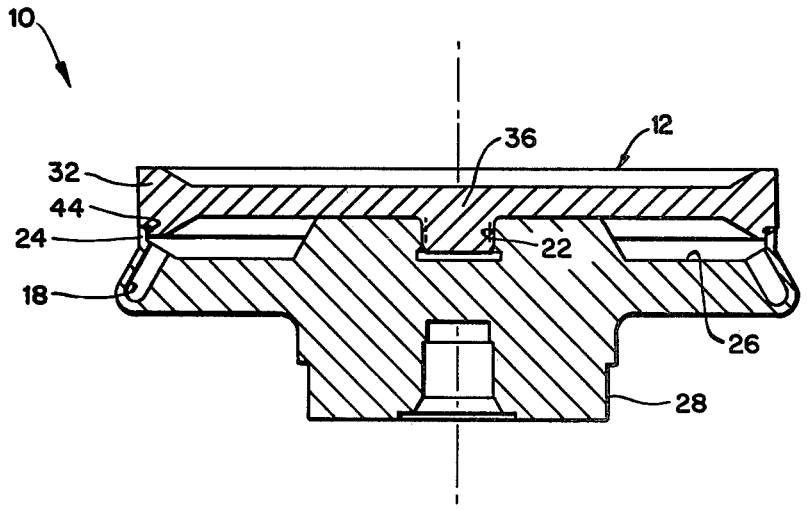
FIG. 4 is a sectional elevation view of the rotor lid apparatus.

Turning to the use and operation of the present invention, attention is directed to FIGS. 3 and 4. After the cavities 18 have been filled with test tubes carrying samples for subjection to centrifugation, the threaded stud 36 of the lid 12 is engaged by hand with the threaded aperture 22 in a lower portion of the rotor 14. Once the lid 12 is manually secured to the lower portion 14 of the rotor, the rim 32 in FIG. 2 is placed closely adjacent the raised perimeter area 24 of the lower portion of the rotor. The O-ring 44 provides a sealing means between the lid and the lower portion of the rotor. The seal created by the manual tightening of the lid 12, however, is not sufficient to withstand the centrifugally induced forces of centrifugation.

After the rotor lid 12 is in position over the rotor lower portion 14, the rotor apparatus 10 is subjected to centrifugation. As the centrifugation speed increases, the centrifugally induced forces on the rim portion 32 of the lid 14 cause the rim 32 to deflect downward slightly toward the lower portion of the rotor causing a greater and tighter seal between the rotor lid 12 and the lower portion 14 of the rotor. The general downward deflection of the rim 32 is facilitated because the top mass portion 48 is greater than the lower mass portion 52 in the rim of the rotor lid. The presence of the annular recessed area 26 allows the thinner central disc area 30 of the lid to deflect as a result of centrifugally induced force on the heavier rim portion 32. Therefore, as rotational speed is increased, the seal between the lid and the lower portion of the rotor is correspondingly increased. The design of the rim portion 32 with its recessed shoulder 40 in conjunction with the raised perimeter area 24 of the rotor will retain the O-ring in its sealing position between the lid and the rotor portion.

Once centrifugation has been completed and the rotor returns to its stationary position, the lid 12 will return to its non-deflected state and reduce the sealing between the rotor lid and the lower portion of the rotor. Consequently, the rotor lid 12 may be removed by hand from the lower portion of the rotor.

The present invention provides a conveniently utilized rotor lid to facilitate easy and convenient removal and replacement of the rotor lid prior to and subsequent to centrifugation. The sealing between the rotor lid and the rotor is automatically increased as the centrifugation speed is increased. The design of the rotor lid rim and rotor retains the O-ring properly positioned for maximum sealing during centrifugation.

What is claimed is:

1. A centrifuge rotor apparatus comprising:

a lower rotor portion having a plurality of cavities for receipt of sample carrying containers;

a lid having a flat and solid contiguous central area;

means projected from the bottom surface of said lid for connecting said lid to said lower rotor portion;

a rim area portion on said lid around the periphery of said flat central area;

means on said rim portion of said lid responsive to centrifugally induced forces during rotation of said rotor for deflecting said rim portion of said lid toward said lower rotor portion, said central area of said lid being thinner than said rim portion to enhance deflection of said central area for establishing sealing engagement between said rim portion and the perimeter area of said lower rotor portion during centrifugation; and an annular recess located in the top surface of said lower rotor portion, said recess being located radially between a central hub and a raised perimeter area of said lower rotor portion, said annular recess accommodating said deflection of said central area during rotation of said rotor.

2. A lid as defined in claim 1 and additionally comprising a sealing element positioned between the perimeter area of said lower rotor portion and said rim area portion.

3. A lid as defined in claim 1, wherein the mass of said rim portion is greater above the top surface of said central area than the mass of said rim below the bottom surface of said central area than the mass of said rim below the bottom surface of said central area.

4. A lid as defined in claim 1, wherein said connecting means comprises a threaded stud projecting from the center of the bottom surface of said central area, said stud being received in a threaded aperture within said lower rotor portion.

* * * * *